US006192981B1

(12) United States Patent
Boquet et al.

(10) Patent No.: US 6,192,981 B1
(45) Date of Patent: Feb. 27, 2001

(54) COILED TUBING HANGER ASSEMBLY

(75) Inventors: Lee J. Boquet; Michael J. Mathias, Sr., both of Shreveport; Billy M. Deville, Heflin, all of LA (US)

(73) Assignee: True Turn Machine, Inc., Bossier City, LA (US)

( * ) Notice: Subject to any disclaimer, the term of this patent is extended or adjusted under 35 U.S.C. 154(b) by 0 days.

(21) Appl. No.: 09/327,427

(22) Filed: Jun. 7, 1999

(51) Int. Cl.[7] ..... E21B 19/10; E21B 33/04

(52) U.S. Cl. ..... 166/75.13; 166/75.14; 166/88.2; 188/67

(58) Field of Search ..... 166/75.11, 75.13, 166/75.14, 77.2, 88.2, 384; 188/67; 294/86.1, 102.2

(56) References Cited

U.S. PATENT DOCUMENTS

| | | | | |
|---|---|---|---|---|
| Re. 20,529 | * | 10/1937 | Penick et al. | 166/75.14 X |
| 1,400,940 | | 12/1921 | Clarke . | |
| 1,458,906 | | 6/1923 | Morisette . | |
| 1,575,998 | | 3/1926 | McKissick . | |
| 2,071,637 | | 2/1937 | Laurent . | |
| 2,410,589 | * | 11/1946 | Segelhorst | 166/75.14 X |
| 2,896,292 | | 7/1959 | Kinzbach . | |
| 3,287,035 | | 11/1966 | Greenwood . | |
| 3,748,702 | * | 7/1973 | Brown | 188/67 |
| 3,791,661 | | 2/1974 | Giles . | |
| 4,326,587 | | 4/1982 | Gauthier . | |
| 4,334,342 | | 6/1982 | Hall . | |
| 4,554,971 | | 11/1985 | Cobb . | |
| 4,646,827 | | 3/1987 | Cobb . | |
| 4,715,625 | * | 12/1987 | Shows, Jr. et al. | 188/67 X |
| 5,031,695 | * | 7/1991 | Cain et al. | 166/75.14 |
| 5,848,647 | * | 12/1998 | Webre et al. | 166/75.14 X |
| 5,964,286 | * | 10/1999 | Cuppen | 166/75.14 X |
| 5,988,273 | * | 11/1999 | Monjure et al. | 166/75.14 X |

* cited by examiner

*Primary Examiner*—George Suchfield
(74) *Attorney, Agent, or Firm*—John M. Harrison

(57) ABSTRACT

A coiled tubing hanger assembly for supporting coiled tubing in a well including, as a first element, a mechanically-assisted slip assembly characterized by multiple slip segments inserted in a tapered slip bowl located in the midsection of a coiled tubing head. The conical slips are constrained to move in concert in the tapered throat of the tubing head midsection by means of a slip retainer ring and rest on a rack cylinder slidably positioned in the bore of the midsection beneath the slips. The rack cylinder is typically fitted with lands and grooves that engage a pinion gear attached to a slip-operating mechanism to facilitate manually raising and lowering the rack cylinder and the slips together, causing the slip teeth to selectively engage and disengage the segment of coiled tubing extending through the slips and the bore of the rack cylinder, into the well. A pack-off assembly is located in the bore of a lower body secured to the midsection of the tubing head for sealing the coiled tubing against well pressure and pack-off screws are radially seated in the lower body to apply pressure to the pack-off assembly for achieving this purpose. A top bonnet is bolted to the top of the midsection and seats a slip cone shaped to engage the top inside surfaces of the slips to maintain the slips in the proper configuration in the midsection.

22 Claims, 5 Drawing Sheets

COILED TUBING HANGER ASSEMBLY

BACKGROUND OF THE INVENTION

1. Field of the Invention

This invention relates to devices and apparatus for suspending tubing, and coiled tubing in particular, in an oil or gas well and more particularly, to a manually-operated coiled tubing hanger assembly for suspending coiled or conventional tubing in a well without the necessity of "killing" the well. The coiled tubing hanger assembly of this invention is characterized by multiple, mechanically-assisted, tapered and collectively conically-shaped slip segments constrained to operate in concert by a retainer ring and positioned in the correspondingly tapered slip bowl of a specially designed tubing head, which includes a top bonnet, a midsection and a lower body, typically bolted together. In a preferred embodiment the slips rest on a rack cylinder having a central longitudinal bore and typically fitted with lands and grooves, which lands and grooves engage a pinion gear attached to one end of a slip-operating mechanism to facilitate manual vertical movement of the rack cylinder, and thus the slips, in the midsection. This action effects selective release and engagement of the slips with a segment of tubing such as coiled tubing, extending through the tubing head, to control insertion and retrieval of the tubing into and from an underlying well. A pack-off assembly is located in the lower body of the tubing head for sealing the coiled tubing hanger assembly against well pressure and the packing seal in the pack-off assembly is facilitated by tapered or bevelled-end pack-off screws extending radially through the lower body to engage the bevelled pack-off plate above the seals in the pack-off assembly. The conical base of a slip cone engages the correspondingly-shaped top inside surfaces of the slips when seated in the midsection and the top bonnet, to maintain the slips in proper functional orientation in the tubing head. A cylinder landing ring is seated in the midsection and lower body interface to limit downward travel of the rack cylinder.

As the downhole pressure in oil and gas wells decreases with time, it is sometimes desirable or necessary to insert tubing in the well to provide a mechanism for more readily removing fluids from the well and prolong the life of the well. Traditionally, it has been necessary to "kill" the well or terminate production by application of hydrostatic pressure in the well, to achieve this objective. A well is "killed" or production is terminated from the well, typically by pumping a fluid such as water into the producing interval to create a hydrostatic head of sufficient magnitude in the well to overcome the well pressure, thereby terminating production. One of the problems inherent in "killing" a producing well which has relatively low pressure, is the difficulty and sometimes impossibility, of restoring the well to production after the desired swabbing, cleaning or workover operation has been accomplished. These and other well maintenance operations are expensive, generally because of the time required to effect such steps as removing the "christmas tree", setting up the necessary apparatus for maintaining the well, placing tubing in the well, (under circumstances where such tubing is deemed necessary), placing a tubing head on the master valve, setting the conventional, usually gravity-operated slip segments and the necessary packing, replacing the "christmas tree" and subsequently attempting to bring the well back into production. If the well cannot be brought back into production, then the time and money expended in the effort has obviously been wasted.

The use of coiled tubing as an alternative to running a production tubing string has received increased attention through the years. Under circumstances where the coiled tubing can be manipulated in a tubing hanger and anchor assembly which is compatible with the needs of the operator, many of the well operating objectives can be accomplished. This is especially true under circumstances where the coiled tubing is designed to keep marginal wells unloaded. For example, the coiled tubing can be used as a cycling string to delay or replace the need for much more expensive or less efficient forms of artificial lift. Furthermore, the coiled tubing can be secured in the slip bowl of the coiled tubing anchor assembly with a close tolerance and can be quickly and easily adjusted up or down, as desired. Other advantages of running coiled tubing in the place of conventional tubing strings in wells will be hereinafter apparent.

2. Description of the Prior Art

Gravity-operated slip assemblies and related equipment of various design have long been employed in the oilfield for suspending pipe and tubing in oil and gas wells. Such assemblies usually consist of multiple, segmented wedges which are tapered and are provided with horizontally-extending teeth located on curved inner surfaces, which teeth are designed to engage and cut into the pipe or tubing to prevent relative movement between the tubing and the slips. The slips usually include several segments which together conform to a tapered, usually conical slip bowl provided in a tubing head and facilitate engagement of the slips by gravity radially about the pipe or tubing when the slips are released inside the slip bowl responsive to contact between the tapered outside surfaces of the slips and the slip bowl in the tubing head. Lowering of the pipe or tubing after release of the slips results in a radial compressive force which urges the segment teeth against the pipe or tubing until the teeth cut into the pipe or tubing wall sufficiently to support the weight of the tubing in the tubing head. The teeth provided in the curved inner face of each slip segment are configured and oriented to engage and cut into the pipe or tubing in an optimum manner, in order to prevent relative movement between the slip segments and the suspended pipe or tubing.

Various devices have long been known in the prior art for supporting casing and tubing in oil and gas wells. An early "Casing Head" is detailed in U.S. Pat. No. 1,400,940, dated Dec. 20, 1921, to C. S. Clarke. The Clarke device includes a clamping member which is adapted to grip a pipe by wedging into engagement with the pipe, responsive to the weight of the pipe. A "Safety Clamp For Diamond Drill Rods" is detailed in U.S. Pat. No. 1,458,906, to N. W. Morisette. The device includes a clamp device having a housing fitted with a sliding element having teeth and a rotating clamping apparatus that selectively engages the teeth to clamp a workstock extending through a bore defined by the teeth. U.S. Pat. No. 1,575,998, dated Mar. 9, 1926, to W. H. McKissick, details a "Tubing Spider" which includes an annular carrier from which slips are suspended, with an operating mechanism for elevating the carrier, such that the slips are retracted into the body of the spider relatively outwardly of the depending guide flange into selective contact with tubing extending through the device. U.S. Pat. No. 2,071,637, dated Feb. 23, 1937, to M. P. Laurent, details a "Slip" characterized by a bushing shaped to fit within a rotary table and a downwardly-tapered, circular seat in the bushing, along with multiple downwardly and inwardly-inclined slideways recessed into the seat of the bushing and slips having outer inclined faces fitting within the slideways, the inner faces of the slips also have a mortised recess opening at the top. An insert having a tenon thereon engages each of the recesses. U.S. Pat. No. 2,896,292, dated Jul. 28, 1959, to R. B. Kinzbach, details an "Automatic Tubing Spider Assembly" which includes a spider body formed with radially-disposed wings having recesses to receive corresponding, radially-movable gripping members pivotally carried on links which are pivotally secured to the spider body. The links are shaped in the configuration of cams provided in camming engagement with the gripping members and with the spider body, thus providing supporting connection between the gripping members and the spider body, as well as between the gripping members and the tubing, when the members sustain a load. U.S. Pat. No. 3,791,661, dated Feb. 12, 1974, to Charles E. Giles, details a "Collet and Collet Fixture". The collet and collet fixture allows an adjustment in the height of a workpiece held in the collet. The collet is locked into position from the bottom by the fixture, providing a secure positioning of the collet and accurate machining of the workpiece. Other patents detailing typical slip-operated tubing head designs are U.S. Pat. No. 3,287,035, dated Nov. 22, 1966, to Greenwood; U.S. Pat. No. 4,334,342, dated Jun. 15, 1982, to Hall; U.S. Pat. No. 4,326,587, dated Apr. 27, 1987, to Gauthier, et al; U.S. Pat. No. 4,554,971, dated Nov. 26, 1985, to Cobb; and U.S. Pat. No. 4,646,827, dated Mar. 3, 1989, also to Cobb.

It is an object of this invention to provide a new and improved tubing hanger assembly for suspending tubing in an oil or gas well using a mechanically-assisted slip assembly to selectively engage and disengage the tubing.

Another object of this invention is to provide a tubing hanger assembly for running tubing, and coiled tubing in particular, in an oil or gas well, which assembly is characterized by multiple, bevelled, collectively conical slip segments loosely connected by a retainer ring and mounted in the correspondingly conical throat of a tubing head. A rack element such as a cylindrical rack cylinder is located in the tubing head beneath the slips and is fitted with teeth or lands and grooves engaged by a pinion gear attached to a slip-operating mechanism, for selectively manipulating the cylinder and the slips upwardly and downwardly in the tubing head and facilitating controlled engagement and release of the slip segments in the slip bowl of the tubing head with tubing placed in the well.

Another object of this invention is to provide a new and improved coiled tubing hanger assembly for use in a specially designed tubing head to suspend coiled tubing in oil and gas wells, typically without "killing" the wells, which hanger assembly includes as the first element, multiple, tapered slip segments clustered in a slip assembly by a retainer ring and disposed in the tapered slip bowl of the tubing head, a cylindrical rack cylinder located in the tubing head beneath the slip segments and engaging the slip segments, teeth or lands and grooves provided on the rack cylinder for engagement by a pinion gear attached to an externally-projecting slip-operating mechanism, to facilitate selective rotation of the pinion gear by manipulation of the slip-operating mechanism, raising and lowering the rack cylinder and the slips in the tubing head and controlled engagement and disengagement of the coiled tubing by the slips.

A still further object of this invention is to provide a coiled tubing hanger assembly for running coiled tubing in a well, which assembly includes a specially designed tubing head having a bonnet, a midsection and a lower body, with a tapered or conical throat provided in the midsection for accommodating multiple, tapered slips assembled in a correspondingly conical configuration on a slip retainer ring and seated on a cylindrical rack cylinder located in a midsection bore communicating with the tapered throat, the rack cylinder having lands and grooves engaged by a pinion gear attached to a slip-operating mechanism. Manual manipulation of the slip-operating mechanism effects selective raising and lowering of the rack cylinder and the slips in the midsection bore and tapered throat, respectively, and selective engagement and disengagement of the slip teeth with the coiled tubing extending through the tubing head adjacent to the slip teeth. A pack-off assembly in the lower body prevents well pressure from interfering with operation of the coiled tubing hanger assembly.

SUMMARY OF THE INVENTION

These and other objects of the invention are provided in a new and improved coiled tubing anchor assembly which, in a preferred embodiment, is characterized by multiple, collectively conically-shaped slip segments positioned in the slip bowl of the midsection of a tubing head, each of the slip segments provided with slip teeth and bevelled or tapered outer surfaces for engaging a correspondingly tapered or conical throat in the midsection. The slip segments are constrained to move vertically in concert in the tapered throat of the midsection by means of a retainer ring and are seated on a rack cylinder having lands and grooves and also vertically and slidably disposed in the midsection bore. The teeth of a pinion gear engage the rack cylinder lands and grooves and the pinion gear is mounted on a slip screw that extends through the wall of the midsection to an external lever or slip screw in the slip-operating mechanism, such that manual manipulation of the lever or slip screw rotates the pinion gear and raises and lowers the rack cylinder and the slips for selectively engaging and disengaging the slip teeth with the coiled tubing extending through the tubing head and into the well. In a preferred embodiment the tubing head further includes a bonnet, typically bolted to the top of the midsection and a lower body bolted to the bottom of the midsection, which lower body includes a packing assembly for sealing the suspended tubing from well pressure. A slip cone is also provided in the bonnet for limiting upward movement of the slips and a cylinder landing ring is seated in the midsection-lower body interface for limiting the downward travel of the rack cylinder.

BRIEF DESCRIPTION OF THE DRAWINGS

The invention will be better understood by reference to the accompanying drawings, wherein.

DESCRIPTION OF THE PREFERRED EMBODIMENTS

Figure 1:
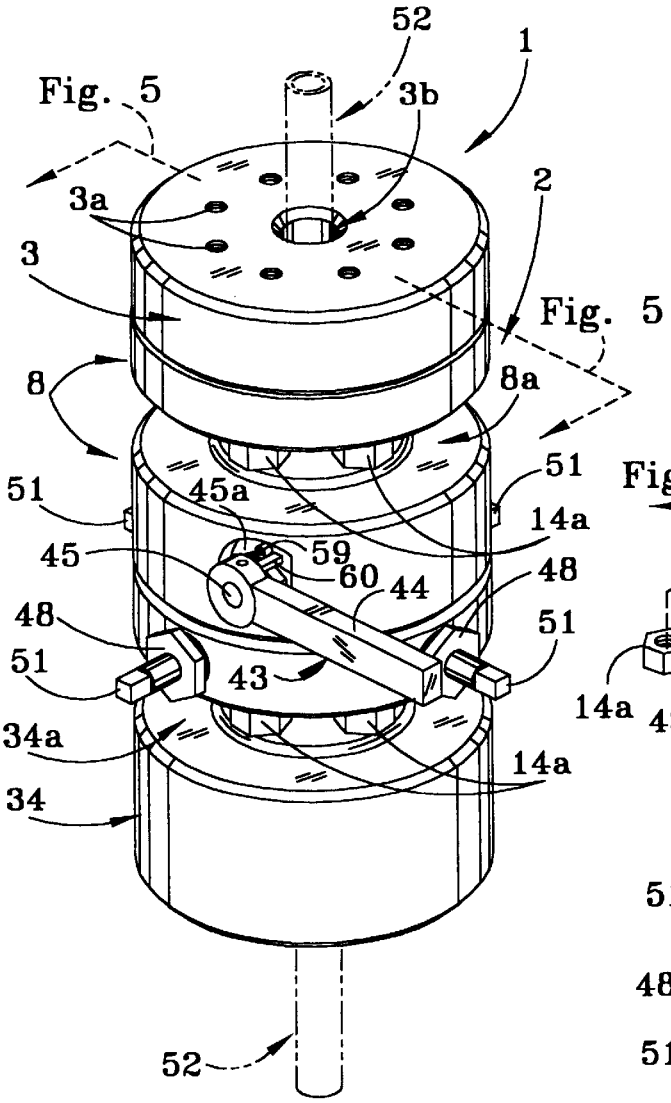
FIG. 1 is a perspective view of a preferred embodiment of the assembled coiled tubing hanger assembly of this invention.
Figure 2:
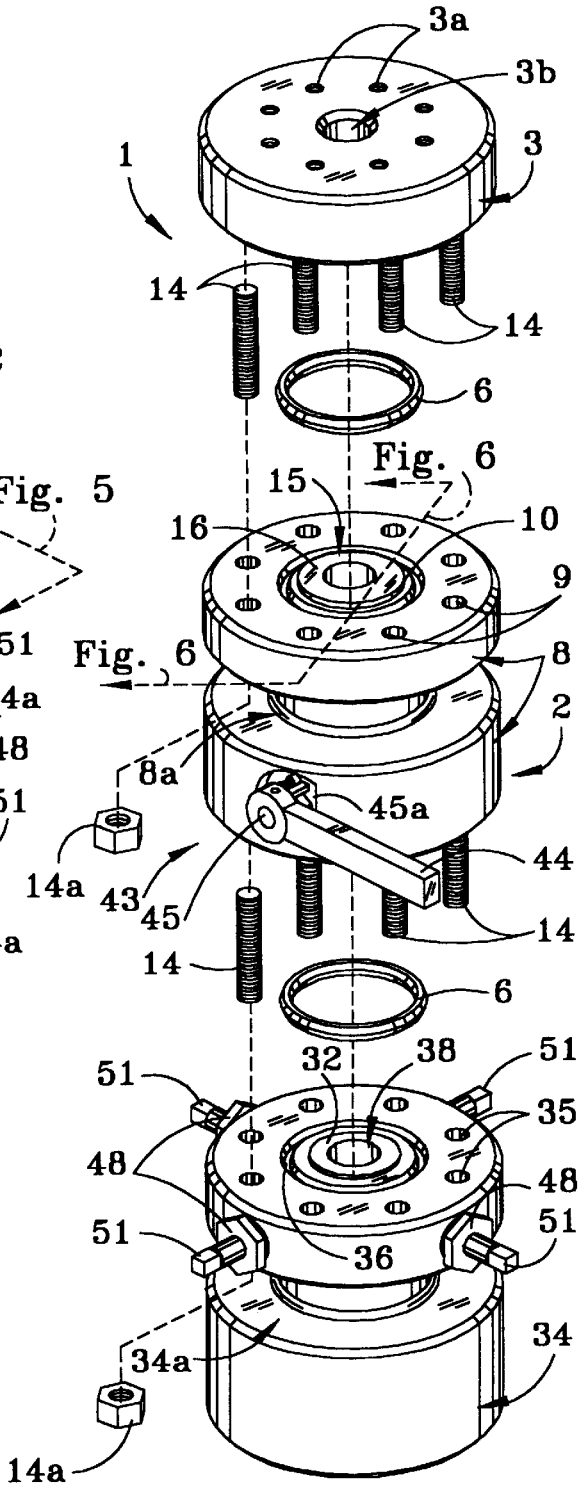
FIG. 2 is an exploded view of the coiled tubing hanger assembly illustrated in FIG. 1.
Figure 5:
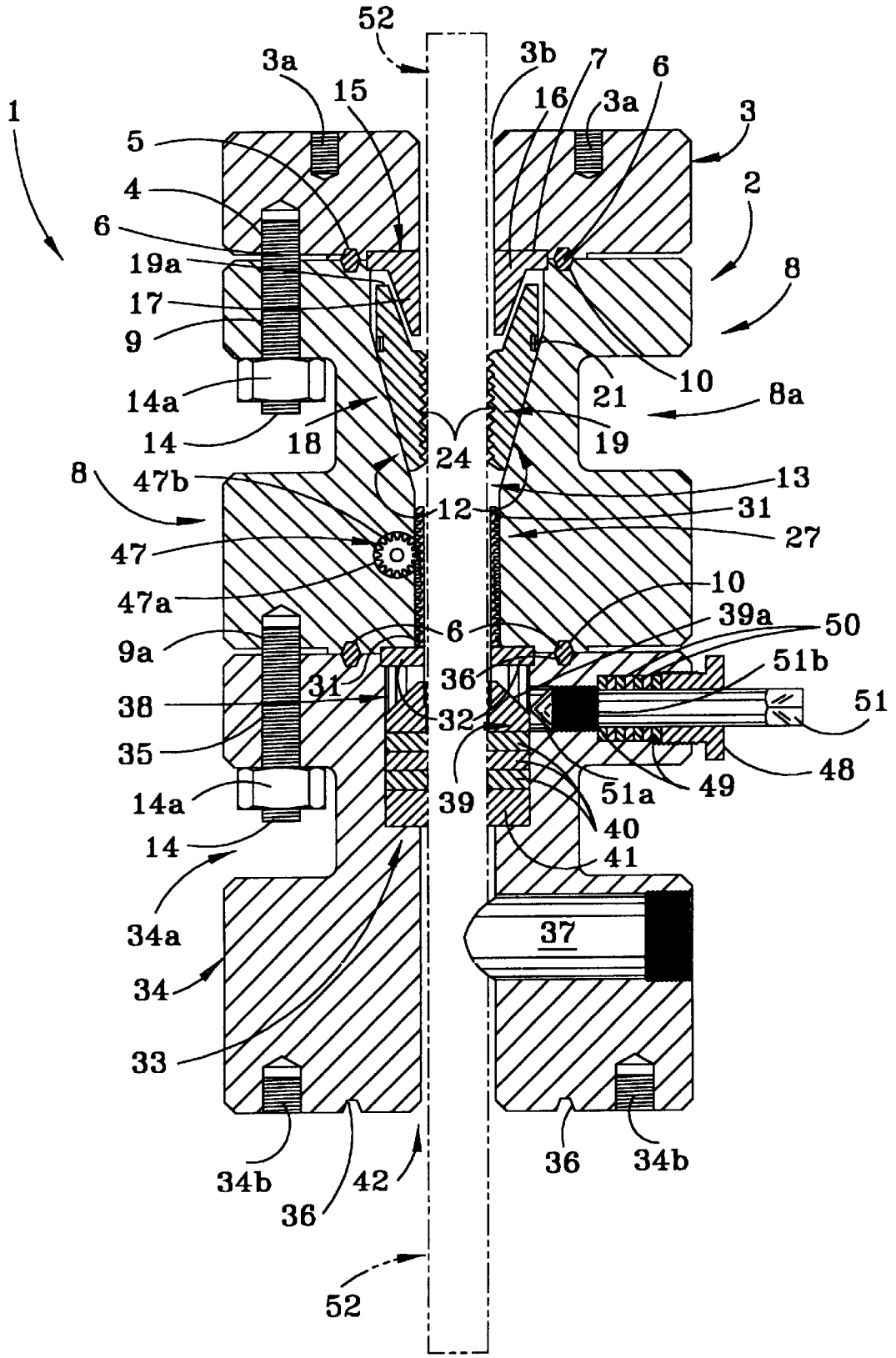
FIG. 5 is a longitudinal sectional view, taken along line 5—5 of the assembled coiled tubing hanger assembly illustrated in FIG. 1.

Referring initially to FIGS. 1, 2 and 5 of the drawings, a preferred embodiment of the coiled tubing hanger assembly of this invention is generally illustrated by reference numeral 1 and is characterized by a tubing head 2, which includes a top bonnet 3, bolted to the top of a midsection 8, the bottom of which midsection 8 is, in turn, bolted to a lower body 34. The top bonnet 3 is characterized by a bonnet bore 3*b*, internally-threaded top bonnet apertures 3*a* and bottom bonnet apertures 4, the latter of which receive threaded studs 14, extending through midsection stud apertures 9 of the midsection 8 and secured in place by means of stud nuts 14*a*. The lower body 34 is likewise attached to the bottom of the midsection 8 by means of additional threaded studs 14, which project through lower body stud apertures 35 and engage the internally threaded midsection apertures 9*a* and are secured by companion stud nuts 14*a*. A midsection access 8*a* and a lower body access 34*a* facilitate wrench access to the respective stud nuts 14*a*, as necessary. The bonnet ring gasket groove 5 and opposed top midsection ring gasket groove 10 accommodate a ring gasket 6 to seal the top bonnet 3 in place on the midsection 8, as further illustrated in FIG. 5. In like manner, the lower one of the midsection ring gasket grooves 10 is aligned with the lower body ring gasket groove 36 and accommodates a second ring gasket 6, to seal the midsection 8 on the lower body 34. A slip cone seat 7 is machined in the bottom face of the top bonnet 3 inside the bonnet ring gasket groove 5, for receiving the top edge of the slip cone flange 16 of a slip cone 15, having a downwardly-extending slip cone base 17.

Figure 4:
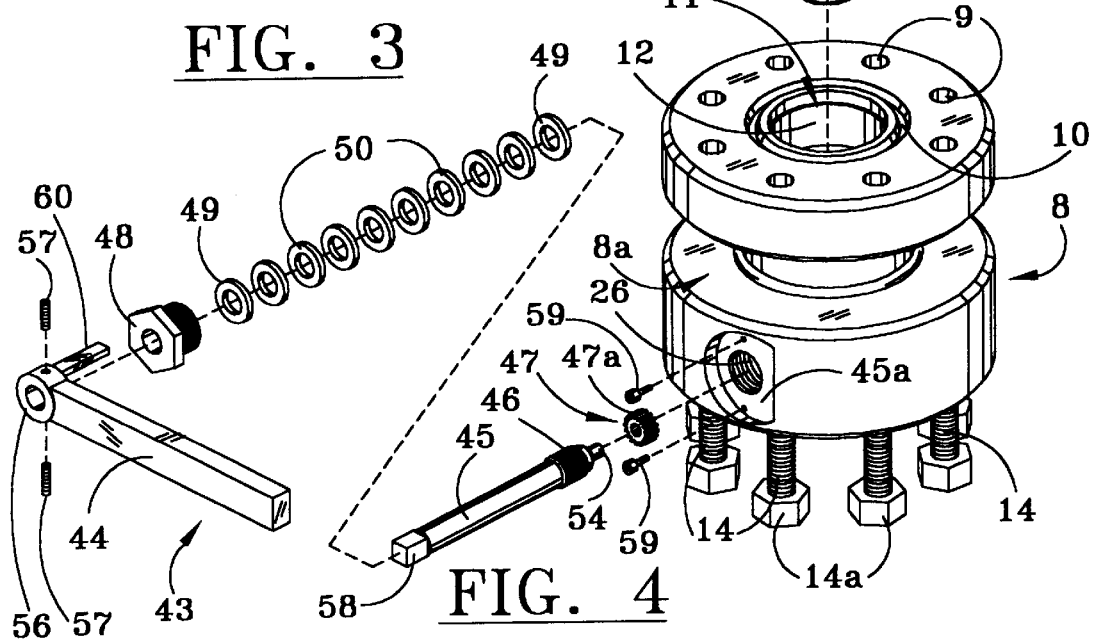
FIG. 4 is an exploded view of the midsection element of the coiled tubing hanger assembly and the respective internal slip cone, slip assembly rack cylinder landing ring and slip operating mechanism elements for seating in the midsection.

A midsection slip bore 11 is provided in the midsection 8 as illustrated in FIG. 4, and communicates with the bonnet bore 3*b* of the top bonnet 3. In a preferred embodiment of the invention, the midsection slip bore 11 tapers from a large diameter at the top thereof to a smaller diameter at the bottom, to define a tapered or conical throat 12, as further illustrated in FIGS. 5 and 6. A midsection rack cylinder bore 13 communicates with the bottom end of the midsection slip bore 11 at the base of the tapered throat 12 and extends downwardly to communicate with the lower body bore 38 and the smaller exit bore 42, of the lower body 34. A lower body outlet 37 is also provided in the lower body 34 for circulating fluid to and from the well without the necessity of pumping the fluid through the tubing head 2. Lower body mount apertures 34*b* are provided in the lower body 34 for attaching the lower body 34, and thus the tubing head 2, to the conventional well head equipment (not illustrated) of a well (also not illustrated).

Figure 6:
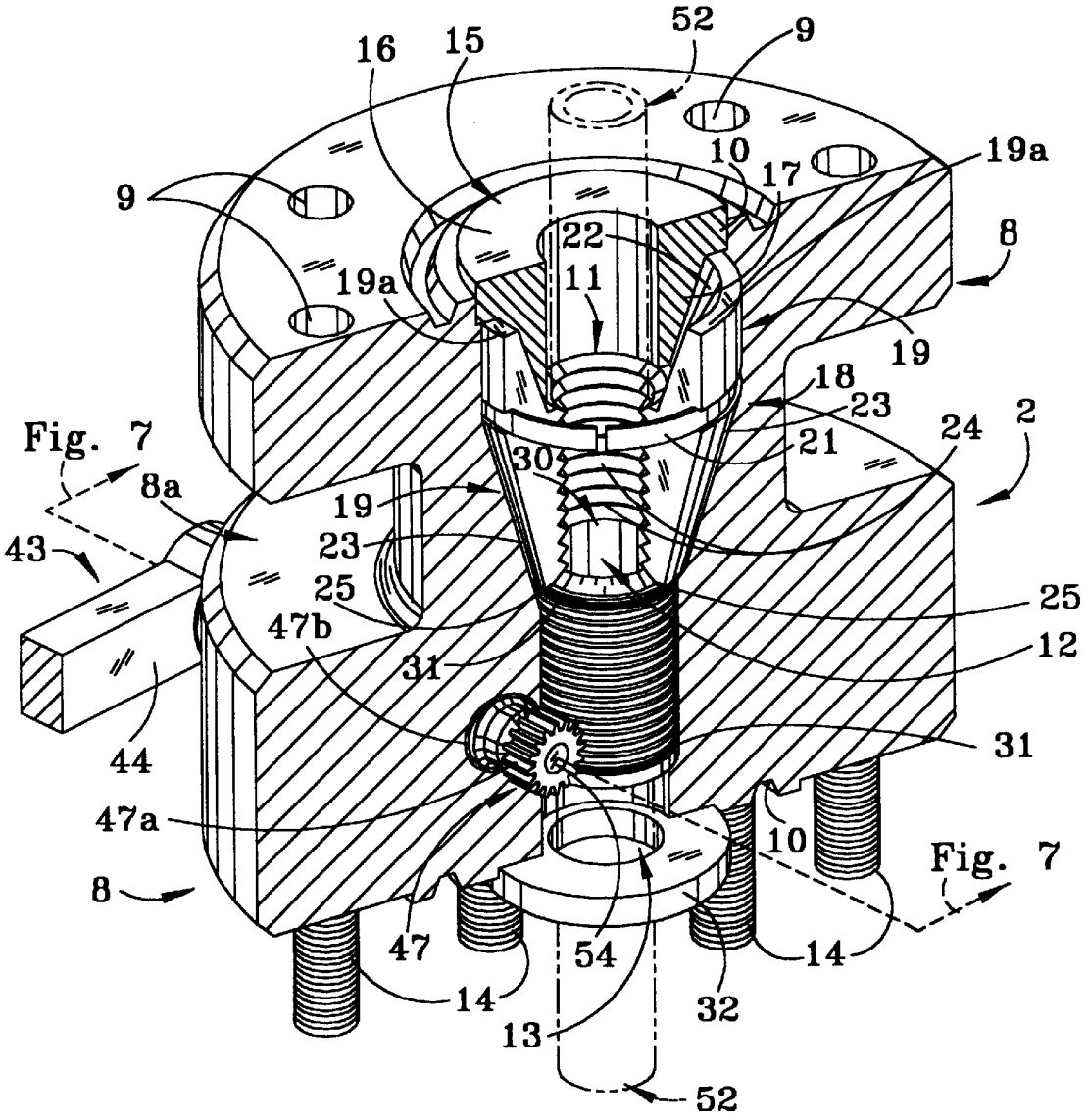
FIG. 6 is a sectional view, taken along line 6—6 of the midsection element of the tubing head illustrated in FIG. 2.

Referring now to FIGS. 4–6 and 8 of the drawings, a slip assembly 18 includes multiple slips 19, each of which have tapered, rounded outer surfaces 23, that terminate in cylinder-engaging edges 25 and collectively define a cone that matches the tapered or conical throat 12 in the midsection 8. Curved inner teeth 24 are provided on the slips 19, below inner arcuate cone base seats 22, for selectively engaging a length of tubing 52, extending through the tubing head 2, as hereinafter further described. The tapered, rounded outer surfaces 23 of the slips 19 engage the tapered throat 12 of the midsection slip bore 11 to facilitate slidable opening and closing of the respective slips 19 in concert, which opening and closing action is loosely orchestrated by a split slip retainer ring 21, extending through corresponding and aligned retainer ring slots 20 in each of these slips 19, as further illustrated in FIGS. 6 and 8. The inner cone base seats 22 are configured to the shape of the slip cone base 17 of the slip cone 15, as illustrated in FIGS. 5 and 6. The top margins 19*a* of the slips 19 are designed to contact the slip cone flange 16 when the slips are in fully disengaged upwardly-extended configuration. Accordingly, it will be appreciated by those skilled in the art that upward movement of the slips 19 in the tapered throat 12 of the midsection slip bore 11 causes the slips 19 to diverge from each other and from the tubing 52 and the slip cone base 17 and toward the slip cone flange 16 in disengaged configuration, and the slips 19 converge into engagement with the tubing 52, when moving downwardly in the tapered throat 12, as the slips 19 operate in concert due to the action of the slip retainer ring 21.

Figure 7:
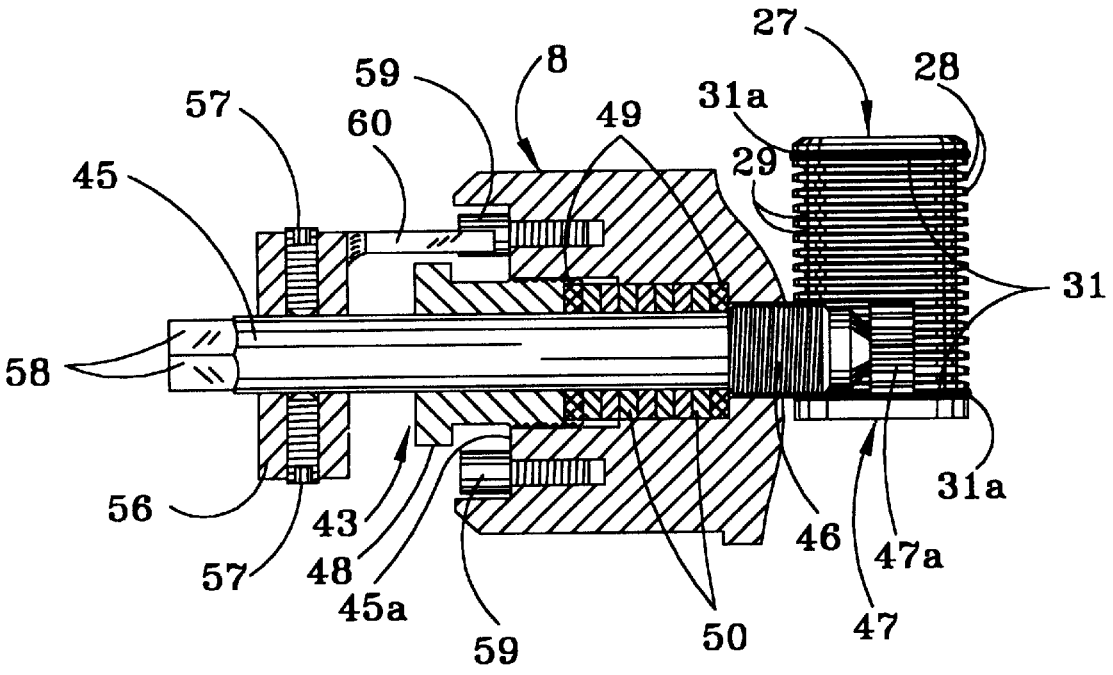
FIG. 7 is a sectional view of a preferred embodiment of the slip-operating mechanism.

As further illustrated in FIGS. 5–7, a rack cylinder 27 is slidably sealed by means of O-rings 31, seated in O-ring seats 31*a*, in the midsection rack cylinder bore 13, which extends beneath and communicates with the tapered throat 12 area of the midsection slip bore 11. In a preferred embodiment the rack cylinder 27 is fitted with alternating lands 28 and grooves 29 and has a longitudinal cylinder bore 30, which accommodates the tubing 52 extending through the slips 19 adjacent to the slip teeth 24. The top of the rack cylinder 27 engages the cylinder engaging edges 25 of the slips 19 when the slips 19 are in diverging, disengaging configuration and the gear teeth 47*a*, provided on a pinion gear 47 element of a slip-operating mechanism 43, engage the lands 28 and the grooves 29 of the rack cylinder 27, as further illustrated in FIGS. 6 and 7. The pinion gear 47 is attached by welding or otherwise, to a pinion gear mount 54, extending from the operating end of a slip screw 45, having slip screw threads 46 that are threaded into a gear access opening 47*b* in the midsection 8. In one embodiment of the invention an external screw lever 44 is attached, typically by means of one or more allen screws 57 (FIG. 4), to the opposite end of the slip screw 45 from the pinion gear 47, to facilitate rotation of the slip screw 45 and the pinion gear 47 and effect vertical adjustment of the rack cylinder 27 and thus, the slips 19, in the midsection rack cylinder bore 13 and the midsection slip bore 11, respectively, (FIGS. 1, 2, 4 and 6.) In a preferred embodiment illustrated in FIG. 7, a wrench nipple 58 is shaped on the projecting end of the slip screw 45 for operating the pinion gear 47 without a screw lever 44. In this embodiment, a typically metal ring 56 is secured to the slip screw 45 by one or more allen screws 57 and an indicator 60 is typically welded or otherwise attached to the ring 56 for engaging a pair of cap screws 59, threaded in in the midsection 8 at the selected extremes of rotation of the slip screw 45 and the pinion gear 47, to act as stops. An indicator 60 is also preferably mounted on the lever 44 of the slip-operating mechanism embodiment illustrated in FIGS. 1, 2, 4 and 6, for engaging a pair of likewise positioned cap screws 59. A gland nut 48 is threaded in a threaded seat 26, provided in a slip screw recess 45*a* in the wall of the midsection 8 and includes a pair of junk rings 49, between which gland nut packing 50 is positioned, to seal the slip screw 45 in the midsection 8 against well pressure.

Figure 3:
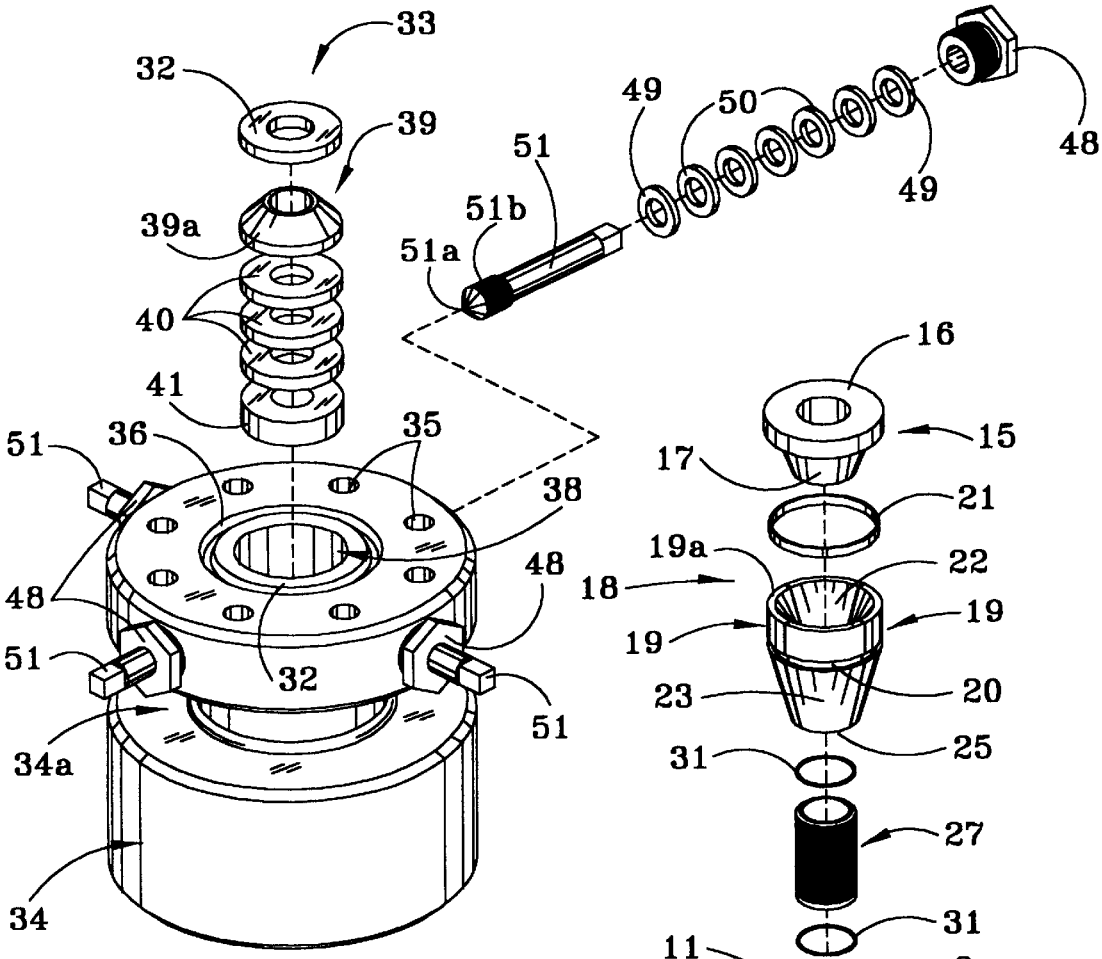
FIG. 3 is a perspective exploded view of the lower body element of the coiled tubing hanger assembly illustrated in FIGS. 1 and 2, more particularly illustrating internal pack-off assembly elements and a preferred pack-off screw and packing design.

Referring now to FIGS. 3, 4 and 5 of the drawings, a pack-off assembly 33 is provided in the enlarged lower body bore 38 of the lower body 34, beneath the cylinder landing ring 32, located at the base of the midsection rack cylinder bore 13. The cylinder landing ring 32 provides a downward stop for movement of the rack cylinder 27. A top pack-off plate 39, having a plate taper 39*a*, is located in the lower body bore 38 immediately beneath the cylinder landing ring 32 and pack-off seals 40 are provided in the lower body bore 38, between the top pack-off plate 39 and a bottom pack-off plate 41, seated in the bottom end of the lower body bore 38. Pack-off screws 51, having bevelled faces 51*a* and screw threads 51*b*, are threaded in radially disposed relationship in the lower body 34, to selectively engage the plate taper 39*a* of the top pack-off plate 39, tighten the top pack-off plate 39 against the pack-off seals 40 and seal the tubing head 2 from well pressure.

Figure 8:
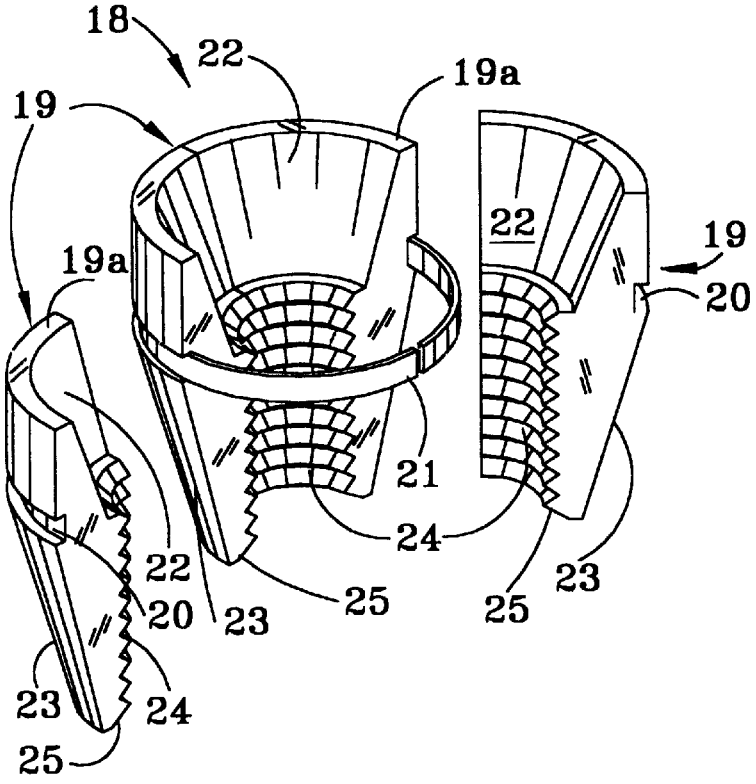
FIG. 8 is a perspective view of a partially assembled slip assembly.

In operation, referring again to the drawings, under circumstances where it is desired to insert a length of tubing 52 into a well without reducing the pressure or "killing" the well, the master valve (not illustrated) in a conventional "christmas tree" (also not illustrated) is initially closed. The "christmas tree" is then removed from the master valve in conventional fashion and the tubing head 2 is installed on the master valve in place of the "christmas tree", by inserting bolts or studs (not illustrated) through the master valve flanges and threading the bolts or studs into the lower body mount apertures 34*b* of the lower body 34, illustrated in FIGS. 4 and 5. The slips 19, which have been loosely assembled in a slip retainer ring 21 to define the slip assembly 18, as illustrated in FIGS. 6 and 8, are then displaced upwardly in concert by upward adjustment of the rack cylinder 27 responsive to manipulation of the lever 44 or application of a wrench (not illustrated) to the wrench nipple 58 (FIG. 7), which rotates the slip screw 45 and the pinion gear 47 and causes the pinion gear 47 to traverse the lands 28 and grooves 29 of the rack cylinder 27. As the slips 19 extend upwardly in concert as a slip assembly 18 in the midsection slip bore 11, the tapered outer surfaces 23 of the slips 19 slide upwardly along the tapered throat 12 of the midsection 8 and the slips 19 diverge from each other and from the slip cone base 17, toward the slip cone flange 16, while orchestrated by the retainer ring 21. When fully open in disengaged configuration, the top margins 19*a* of the slips 19 typically contact the slip cone flange 16 of the slip cone 15, as illustrated in FIG. 6. This action facilitates retraction of the slip teeth 24 in a radial direction to facilitate insertion of the tubing 52 through the bonnet bore 3*b* of the top bonnet 3, the slip assembly 18, the midsection slip bore 11 and the cylinder bore 30 of the rack cylinder 27, the midsection rack cylinder bore 13 and through the top pack-off plate 39, the pack-off seals 40 and the bottom pack-off plate 41 and finally, through the exit bore 42 of the lower body 34, into the well.

Accordingly, the tubing 52, which is typically coiled tubing wound on a drum (not illustrated) positioned in cooperation with a tubing running unit (also not illustrated) designed to insert the tubing 52 in a well, is then positioned near the well location and in a typical operating set-up the tubing head 2 is seated on a valve and typically, "a christmas tree" combination (not illustrated). An appropriate blowout preventor system (further not illustrated) is then mounted on the top bonnet 3 of the tubing head 2 in association with the tubing 52, typically by bolts or studs threaded into the top bonnet apertures 3*a*, according to procedures well known to those skilled in the art. The tubing running unit is then set up for inserting one end of the tubing 52 into the well through the blowout preventors and the tubing head 2 as indicated above, and the well is subsequently "packed off" or sealed above the blowout preventors in conventional fashion, to prevent the working pressure in the well from escaping around the tubing 52 when the tubing 52 is inserted in the tubing head 2. Before insertion, the inserted end of the tubing 52 is typically closed by means of a plug and the plugged end of the tubing 52 is extended through the tubing head 2 as described above, to the closed master valve. The packing in the tubing running unit is then tightly compacted in conventional fashion, the master valve is opened and the tubing 52 is then unwound from the drum and extended into the well to the desired depth.

When the tubing 52 has been inserted in the well to the desired depth and while it is supported by the tubing running unit, the slip assembly 18 is activated by operation of the lever 44 or the wrench nipples 58 in the slip-operating mechanism 43, and rotation of the slip screw 45 to rotate the gear teeth 47*a* of the pinion gear 47 in the lands 28 and grooves 29 of the rack cylinder 27 and lower the rack cylinder 27 and the slip assembly 18 in the midsection slip bore 11. This action causes the slips 19 to converge in the tapered throat 12 of the midsection slip bore 11, since the slip taper 23 of each of the slips 19 engages the tapered throat 12 and causes the respective slip teeth 24 of the slips 19 to engage the tubing 52, as illustrated in FIG. 5. The slip-operating mechanism 43 is then operated to lower the rack cylinder 27 from the tapered throat 12, fully into the non-tapered area of the midsection rack cylinder bore 13, to prevent interference with operation of the slips 19.

In a preferred embodiment of the invention the slip-operating mechanism 43 is so designed that a one-quarter to one-half turn of the slip screw 45 by manipulation of the lever 44 will effect sufficient vertical movement of the rack cylinder 27 to facilitate full movement of the slips 19 from disengagement of the slip teeth 24 with the tubing 52, to engagement with the tubing 52. However, it is understood that the degree of rotation is determined by the size and spacing of the lands 28 and grooves 29 on the rack cylinder 27 and the diameter of the pinion gear 47, together with the spacing of the gear teeth 47*a*. The cap screws 59 (FIGS. 1, 2 and 7) are typically located at the required extremes of rotation for engagement by the indicator 60, as heretofore described. The slip assembly 18 is now in position such that the tubing 52 cannot deploy further into the well and regardless of the weight of the tubing 52 extending into the well, the tubing 52 will not slip from the engaged position illustrated in FIG. 5. When the slips 19 are properly positioned in the tapered throat 12 of the midsection slip bore 11 such that the respective slip teeth 24 securely engage the tubing 52, the tubing running unit is adjusted to reduce the supporting force on the tubing 52 and as the weight of the tubing 52 in the well is brought to bear on the slip teeth 24 of the slips 19, the slip teeth 24 penetrate the outer surface of the tubing 52 and the slip assembly 18 securely supports the tubing 52 in the well without slippage. The pack off screws 51 are then rotated in the clockwise direction to cause the bevelled faces 51*a* to exert pressure on the plate taper 39*a* of the top-bevelled top pack-off plate 39, which action tightens the pack-off seals 40 located between the top pack-off plate 39 and the bottom pack-off plate 41, and securely seal the tubing 52 in the tubing head 2 against well pressure. When this sealing is accomplished, the tubing 52 is considered to be "packed off" in the tubing head 2 and the pressure of the well is tested above the tubing head 2 to insure that the pack-off seals 40 located between the top pack-off plate 39 and the bottom pack-off plate 41 are holding the well pressure. The tubing running unit and the blowout preventors may then be removed from the tubing head 2 and the tubing 52 is typically cut at a point about six inches above the tubing head 2, a second valve is flanged to the top bonnet 3 of the tubing head 2 using the top bonnet apertures 3*a* in conventional fashion and the bottom valve becomes the master valve. Flow or production lines are then reattached as required, and nitrogen is typically pumped through the "christmas tree" into the open end of the tubing 52 to remove the plug from the opposite end of the tubing 52, which extends into the well. The well is then ready to produce hydrocarbons through the exit bore of the lower body outlet 37 located in the lower body 34, and through the tubing bore of the tubing 52, as desired.

Referring again to FIG. 5 of the drawings, it will be appreciated by those skilled in the art that the slip assembly 18 and the rack cylinder 27 can be easily accessed from the interior of the midsection 8 by removing the top bonnet 3 as the respective stud nuts 14*a* are removed from the companion studs 14. This action clears the slip cone 15 for easy removal from the midsection slip bore 11 and facilitates removal of the slip assembly 18 as a unit from the tapered throat 12. When the slip assembly 18 is thusly removed, the rack cylinder 27 may then be engaged by a tool suitable for the purpose and extended from the midsection rack cylinder bore 13, after the pinion gear 47 is removed with the slip-operating mechanism 43 through the gear access opening 47*b*, by unthreading the gland nut 48, to clear the gear teeth 47*a* from lands 28 and grooves 29 of the rack cylinder 27. Accordingly, it will be appreciated by those skilled in the art that replacement of the slip cone 15, the slips 19 and the slip assembly 18, as well as the rack cylinder 27, is easily accomplished on the job in this manner for maintenance purposes. Replacement or repair of the pack-off assembly 33 is effected by removing the stud nuts 14*a* from the studs 14 that secure the midsection 8 to the lower body 34, as illustrated in FIG. 5. Secure sealing of the slip screw 45 and the pack-off screws 51 in the midsection 8 against well pressure is accomplished by tightening the respective gland nuts 48, squeezing the packing 50, in conventional manner.

It will be further appreciated by those skilled in the art that the coiled tubing hanger assembly of this invention is versatile and offers many advantages over prior art equipment for inserting tubing and coiled tubing in particular, in an oil or gas well. Since the working pressure of the well does not need to be neutralized in order to insert the tubing in the well, there is therefore no necessity for using a workover rig or relying on special tools and equipment. Furthermore, a coiled tubing hanger assembly can be used to place tubing in the well under pressure and under circumstances where terminating pressure might cause permanent loss or production, where the only alternative to effect continued production is use of a pumping unit, sucker rod string and downhole pump. The coiled tubing hanger assembly of this invention can be used on wells of substantially any depth to support tubing under circumstances where the use of such tubing is feasible. Furthermore, since the use of the coiled tubing hanger assembly of this invention results in faster, more efficient insertion of tubing in a well, the operation is rendered safer and less expensive due to the reduced time of exposure to the well by the operators. An added positive feature is the capability of re-working the coiled tubing hanger assembly of this invention in the field according to the procedure outlined above without the necessity of removing the tubing head and taking it to a shop for the necessary maintenance and repairs.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A coiled tubing anchor assembly for supporting tubing in a well, comprising a tubing head having an internal bore for receiving the tubing and a tapered throat provided in said bore; a plurality of slips provided in said bore, said slips having tapered surfaces sidably engaging said tapered throat and slip teeth provided on said slips, said slip teeth facing inwardly of said bore adjacent the tubing; a rack element slidably disposed in said bore beneath said slips and rack projections provided on said rack element; a gear disposed for rotation in said tubing head and gear teeth provided on said gear for engaging said rack projections on said rack element; and a rotatable slip-operating mechanism extending into said tubing head and engaging said gear, wherein said rack element and said slips are slidably displaced in said bore and said tapered throat, respectively, and said slip teeth selectively engage and disengage the tubing responsive to rotation of said slip-operating mechanism and said gear.

2. The coiled tubing anchor assembly of claim 1 comprising a slip cone provided in said bore of said tubing head above said slips for limiting the upward travel of said slips in said bore.

3. The coiled tubing anchor assembly of claim 1 comprising a landing ring provided in said bore of said tubing head below said rack element for limiting the downward travel of said rack element in said bore.

4. The coiled tubing anchor assembly of claim 1 comprising:

a slip cone provided in said bore of said tubing head above said slips for limiting the upward travel of said slips in said bore; and a landing ring provided in said bore of said tubing head below said rack element for limiting the downward travel of said rack element in said bore.

5. The coiled tubing anchor assembly of claim 1 wherein said rack element comprises a rack cylinder having a longitudinal bore for receiving the tubing and wherein said rack projections comprise lands and grooves for engaging said gear teeth of said gear.

6. The coiled tubing anchor assembly of claim 5 comprising a slip cone provided in said bore of said tubing head above said slips for limiting the upward travel of said slips in said bore.

7. The coiled tubing anchor assembly of claim 5 comprising a landing ring provided in said bore of said tubing head below said rack element for limiting the downward travel of said rack element in said bore.

8. The coiled tubing anchor assembly of claim 5 comprising:

a slip cone provided in said bore of said tubing head above said slips for limiting the upward travel of said slips in said bore; and a landing ring provided in said bore of said tubing head below said rack element for limiting the downward travel of said rack element in said bore.

9. The coiled tubing anchor assembly of claim 1 comprising a pack-off assembly provided in said bore beneath said rack element for sealing said rack element and said slips from well pressure.

10. The coiled tubing anchor assembly of claim 9 comprising:

a slip cone provided in said bore of said tubing head above said slips for engaging said slips and limiting the upward travel of said slips in said bore; and a landing ring provided in said bore of said tubing head below said rack element for engaging said slips and limiting the downward travel of said rack element in said bore.

11. The coiled tubing anchor assembly of claim 10 wherein said rack element comprises a rack cylinder having a longitudinal bore for receiving the tubing and wherein said rack projections comprise lands and grooves for engaging said gear teeth of said gear.

12. The coiled tubing anchor assembly of claim 9 comprising at least one pack-off screw extending through said tubing head to said pack-off assembly for applying pressure to said pack-off assembly and securing said pack-off assembly against the well pressure.

13. The coiled tubing anchor assembly of claim 12 comprising:

a slip cone provided in said bore of said tubing head above said slips for engaging said slips and limiting the upward travel of said slips in said bore; and a landing ring provided in said bore of said tubing head below said rack element for engaging said slips and limiting the downward travel of said rack element in said bore.

14. The coiled tubing anchor assembly of claim 13 wherein said rack element comprises a rack cylinder having a longitudinal bore for receiving the tubing and wherein said rack projections comprise lands and grooves for engaging said gear teeth of said gear.

15. A coiled tubing anchor assembly for supporting tubing in a well, comprising a tubing head having an internal bore for receiving the tubing and a tapered throat provided in said bore; a tapered slip cone provided in said bore; a plurality of slips provided in said bore beneath said slip cone, said slips having tapered outer surfaces slidably engaging said tapered throat and tapered inner surfaces slidably engaging said slip cone and slip teeth provided on said slips, said slip teeth facing inwardly of said bore adjacent the tubing; a rack element sidably disposed in said bore beneath said slips and rack projections provided on said rack element; a gear disposed for rotation in said tubing head and gear teeth provided on said gear for engaging said rack projections on said rack element; and a rotatable slip-operating mechanism extending into said tubing head and engaging said gear, wherein said rack element and said slips are slidably displaced in said bore and said tapered throat, respectively, and said slip teeth selectively engage and disengage the tubing responsive to rotation of said slip-operating mechanism and said gear.

16. The coiled tubing anchor assembly of claim 15 comprising a landing ring provided in said bore of said tubing head below said rack element for limiting the downward travel of said rack element in said bore.

17. The coiled tubing anchor assembly of claim 16 comprising a slip cone flange provided on said slip cone for engaging said slips and limiting the upward travel of said slips in said bore.

18. The coiled tubing anchor assembly of claim 17 wherein said rack element comprises a rack cylinder having a longitudinal bore for receiving the tubing and wherein said rack projections comprise lands and grooves for engaging said gear teeth of said gear.

19. The coiled tubing anchor assembly of claim 18 comprising a pack-off assembly provided in said bore beneath said rack element for sealing said rack element and said slips from well pressure and at least one pack-off screw extending through said tubing head to said pack-off assembly for applying pressure to said pack-off assembly and securing said pack-off assembly against the well pressure.

20. A coiled tubing anchor assembly for supporting tubing in a well, comprising a tubing head having an internal bore for receiving the tubing and a tapered throat provided in said bore; a slip cone provided in said bore, said slip cone having a flange and a tapered base extending from said flange; a plurality of slips provided in said bore, said slips having tapered outer surfaces sidably engaging said tapered throat and tapered inner surfaces sidably engaging said tapered base of said slip cone and slip teeth provided on said slips, said slip teeth facing inwardly of said bore adjacent the tubing; a rack cylinder sidably disposed in said bore beneath said slips and lands and grooves provided on said rack cylinder; a gear disposed for rotation in said tubing head and gear teeth provided on said gear for engaging said lands and grooves on said rack cylinder; and a rotatable slip-operating mechanism extending into said tubing head and engaging said gear, wherein said rack cylinder and said slips are sidably displaced in said bore and said tapered throat, respectively, and said slip teeth selectively engage and disengage the tubing responsive to rotation of said slip-operating mechanism and said gear.

21. The coiled tubing anchor assembly of claim 20 comprising a landing ring provided in said bore of said tubing head below said rack cylinder for limiting the downward travel of said rack cylinder in said bore.

22. The coiled tubing anchor assembly of claim 21 comprising a pack-off assembly provided in said bore beneath said rack cylinder for sealing said rack cylinder and said slips from well pressure and at least one pack-off screw extending through said tubing head to said pack-off assembly for applying pressure to said pack-off assembly and securing said pack-off assembly against the well pressure.

* * * * *